US006138619A

United States Patent [19]

Etemad

[11] Patent Number: 6,138,619

[45] Date of Patent: Oct. 31, 2000

[54] DEVICE FOR CONTROL OF FLOW OF COOLING MEDIUM

[75] Inventor: Sassan Etemad, Västra Frölunda, Sweden

[73] Assignee: AB Volvo, Sweden

[21] Appl. No.: 09/091,586

[22] PCT Filed: Dec. 13, 1996

[86] PCT No.: PCT/SE96/01655

§ 371 Date: Sep. 9, 1998

§ 102(e) Date: Sep. 9, 1998

[87] PCT Pub. No.: WO97/23718

PCT Pub. Date: Jul. 3, 1997

[30] Foreign Application Priority Data

Dec. 22, 1995 [SE] Sweden ..... 9504614

[51] Int. Cl.[7] ..... F02F 1/14; F02F 11/00; F01P 3/02

[52] U.S. Cl. ..... 123/41.74; 123/41.79

[58] Field of Search ..... 123/41.79, 41.74, 123/41.28

[56] References Cited

U.S. PATENT DOCUMENTS

| | | | |
|---|---|---|---|
| 2,960,974 | 11/1960 | Olsen et al. | 123/41.74 |
| 4,109,617 | 8/1978 | Ernest | 123/41.74 |
| 4,493,294 | 1/1985 | Umemura | 123/41.74 |
| 4,601,265 | 7/1986 | Wells et al. | 123/41.74 |
| 5,000,464 | 3/1991 | Yasui . | |
| 5,052,348 | 10/1991 | Takakura et al. | 123/41.74 |
| 5,092,283 | 3/1992 | Holt | 123/41.74 |

FOREIGN PATENT DOCUMENTS

| | | |
|---|---|---|
| 0261506 A2 | 3/1988 | European Pat. Off. . |
| 0308033 A2 | 3/1989 | European Pat. Off. . |

*Primary Examiner*—Noah P. Kamen
*Assistant Examiner*—Jason Benton
*Attorney, Agent, or Firm*—Lerner, David, Littenberg, Krumholz & Mentlik, LLP

[57] ABSTRACT

The invention relates to a device for control of flow of a cooling medium which is led through a channel (5) in an internal combustion engine (1), comprising at least one flow directing element (14, 17, 23) arranged in the channel (5) for directing passing cooling medium in a predetermined direction. The invention is characterized in that said flow directing elements (14, 17, 23) are supported by a supporting element (13, 11, 16, 20) intended to be mounted on said internal combustion engine (1), with said flow directing elements (14, 17, 23) so arranged that they protrude from the supporting element (13, 11, 16, 20) and into said channel (5). The invention provides an improved device for controlling the direction of flow of a cooling medium in an internal combustion engine, thus creating a more optimal cooling of the internal combustion engine.

6 Claims, 5 Drawing Sheets

DEVICE FOR CONTROL OF FLOW OF COOLING MEDIUM

TECHNICAL FIELD

The present invention relates to a device for control of flow of cooling medium according to the preamble of claim 1. The main application of the invention is in connection with controlling the flow of cooling medium in an internal combustion engine in a motor vehicle.

TECHNICAL BACKGROUND

In connection with internal combustion engines intended for, for example, motor vehicles, cooling of the different engine components is usually required. In an earlier known kind of internal combustion engine, the cylinders are arranged in line or in a V-shape in a cast cylinder block. On the outside of the cylinders there is a cooling channel which forms a casing where a cooling medium, which is usually water or a glycol mixture, can flow in order to cool the cylinder block. In this previously known internal combustion engine, the cooling water is supplied from a water pump, and into the cylinder block. After the cooling water has passed the cylinders, it is led to the cylinder head, where it is used to cool other parts of the engine, for example the exhaust and inlet valves of the cylinder head.

Although the above described cooling of the cylinder block in principle functions satisfactorily, there is a problem since the cooling might have a tendency to become uneven. This is particularly noticeable in those engines where the cylinder block is manufactured in aluminum using press casting. This is due to the fact that this method of manufacturing limits the possibilities of tailoring the castings (and thereby also the cooling channel) in such a way that the castings cannot always be given for example the desired thickness and shape in all the places where this is desirable. It is, for example, not possible using this casting method to shape the cylinder block with sharp edges and thin passages wherever desired in the castings. Because of this, the shape of the cooling channel cannot usually be optimized with regard to the cooling of the cylinder block, which in turn leads to different parts of the cylinder block being cooled to varying extents. This leads to a non-optimal cooling where there, in some cases, might be a risk of deformation in the material in the cylinder block.

There is thus a need for a more active control of the flow of the cooling medium in the cooling channel around the cylinders, which would create the possibility of a more even and more optimal cooling of the cylinder block.

There are previously known arrangements, the purpose of which being to accomplish improved cooling of an internal combustion engine. An arrangement which comprises control means for controlling the cooling medium in a cylinder block is previously known from EP 0 261 506. This arrangement comprises a plurality of "turbulence sheets", which are intended to be installed on each cylinder in an engine. The turbulence sheets are arranged to control the flow of the cooling medium so that a more optimal cooling is obtained.

This known arrangement, however, causes a problem in that it is a relatively complicated solution, which requires the installing of the above mentioned turbulence sheets on all of the cylinders in the internal combustion engine, which is time-demanding and costly.

There is thus a need to solve this problem and to accomplish a more cost efficient solution which, in particular, allows a simple, quick, and efficient installation on the cylinder block.

SUMMARY OF THE INVENTION

A main purpose of the present invention is thus to solve the above mentioned problems, and to obtain an improved arrangement for controlling the direction of flow of a cooling medium in an internal combustion engine. This is accomplished by an arrangement of the kind mentioned initially, the characteristics of which will become apparent from claim 1.

By using a plurality of flow directing elements which are arranged in the cooling channel, and which are further supported by a supporting element which, in a preferred embodiment, consists of a conventional gasket, an integrated and easily assembled unit is obtained. This unit is installed so that the flow directing elements protrude from the supporting element and into the channel.

In a particular embodiment, the gasket consists of a plurality of layers, and the flow directing element is fixedly arranged between two such layers.

In a further embodiment, the gasket comprises apertures from which a part of an embedded laminate layer protrudes. This protruding part of the laminate layer is bent downwards from the gasket, so that it forms a wing which is used as a flow directing element.

DESCRIPTION OF THE FIGURES

The invention will be described in the following in greater detail and with reference to the appended drawings, in which.

PREFERRED EMBODIMENTS

Figure 1:
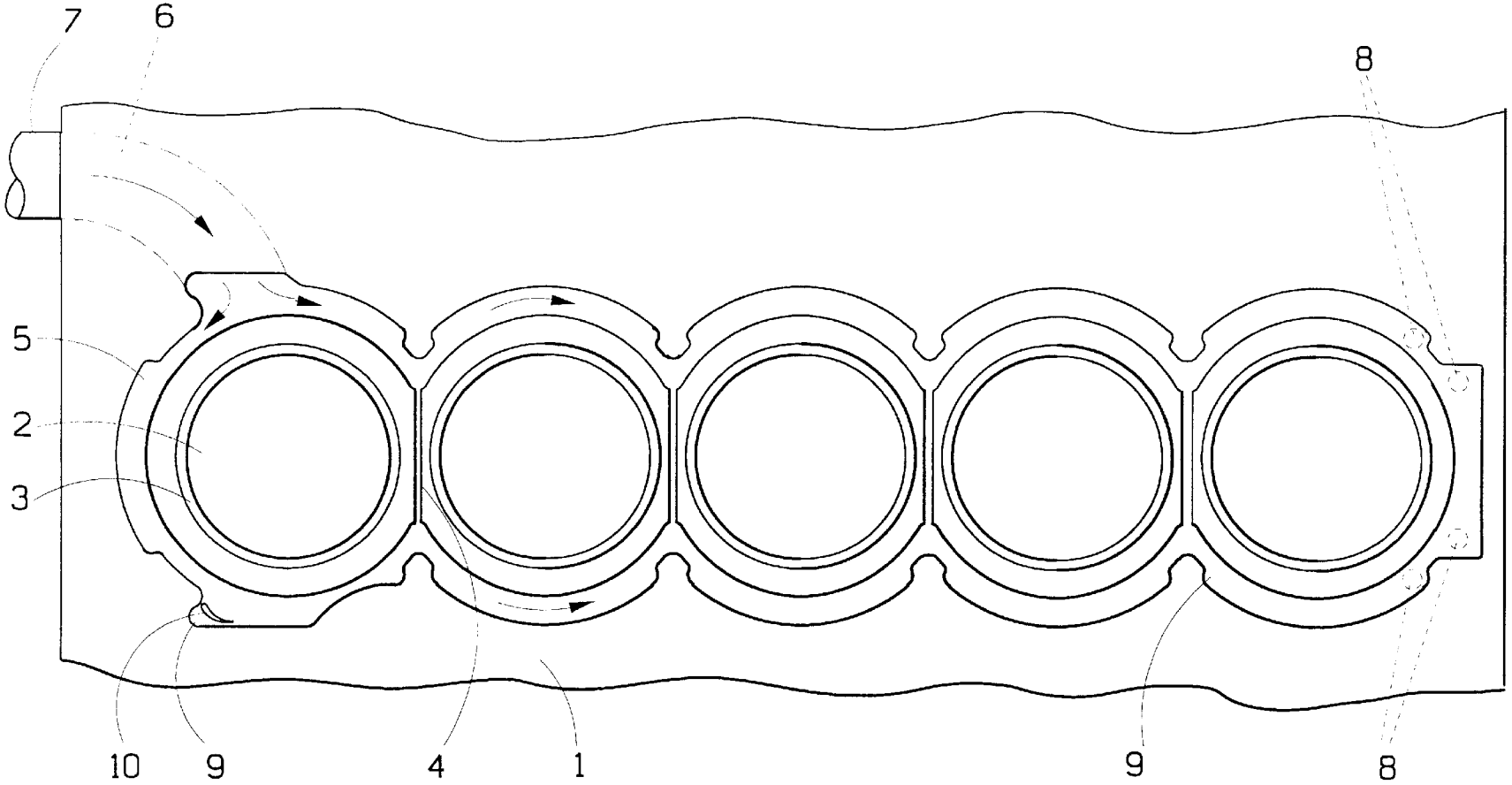
FIG. 1 is a simplified plan-view of a cylinder block in which the arrangement according to the present invention can be used.

FIG. 1 shows a plan-view of a cylinder block 1, which is a primary component in an internal combustion engine of a mainly conventional kind, which is intended for motor vehicles, for example passenger cars and trucks. The drawing is somewhat simplified, and does not show all the components which make up a conventional cylinder block. The cylinder block 1, which preferably has been made by press-casting aluminum or an aluminum alloy, comprises five cylinders 2. The man skilled in the art will, however, realize that the number of cylinders can vary. Each cylinder 2 is equipped with a cylinder lining 3, which preferably is made of steel. Between the cylinders 2 there is, in the example shown, four thin apertures 4.

The upper side of the cylinder block 1 is arranged to support a washer, which is not shown in FIG. 1, but the function and appearance of which will be described in detail below. The internal combustion engine further comprises a (not shown) cylinder head, which comprises further engine components, i.a. valves for injecting fuel and for removing exhaust gases.

A channel 5, intended to lead a cooling medium through the cylinder block 1 is arranged around the five cylinders 2.

The channel 5 has a certain width, and a depth downwards into the cylinder block 1. A corresponding channel is also arranged in said cylinder head (not shown). The width and depth are dimensioned according to the cooling need for the cylinder block 1 in question. The cylinder block 1 further comprises an inlet 6, to which a pipe 7 for the supply of a cooling medium is connected. The pipe 7 is, in turn, connected to a (not shown) pump which is arranged in the vehicle, preferably close to the internal combustion engine. The cooling medium is preferably water or a glycol mixture, but other cooling media are also possible. The cooling medium is led around the outside of each cylinder 2, as shown with arrows in FIG. 1. When the cooling medium has passed all the cylinders 2, it is led to a cooling channel in the cylinder head of the engine via apertures 8, which have been made in the above mentioned (and not shown) gasket. The apertures 8 are indicated in FIG. 1 with broken lines.

FIG. 1 shows the channel 5 as comprising irregularities in the shape of, for example, a protruding part 9. Such parts in the channel 5 are caused mainly by the process of manufacture, i.e. press-casting, of the cylinder block 1. As mentioned initially, this method of manufacture limits the shaping of the cylinder block 1. The presence of portions such as, for example, the protruding part 9 can result in a fall of pressure in the cooling medium as it flows past. This in turn will cause an uneven cooling of the cylinder block 1 as described above.

Figure 2:
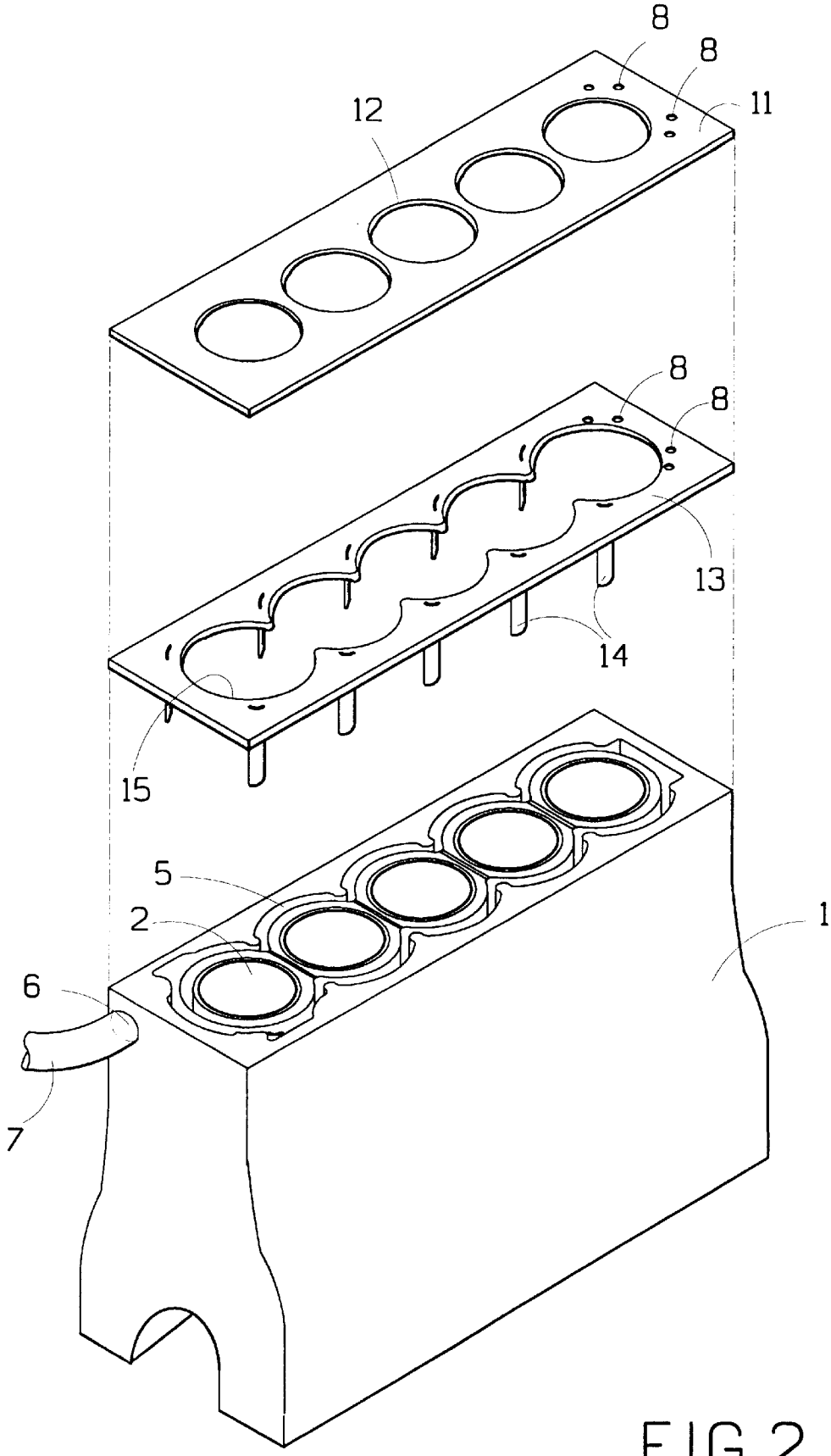
FIG. 2 is a perspective view of a first embodiment of the present invention.

In order to solve this problem, the channel 5 is equipped with a flow directing element in the shape of a wing, flap, or "spoiler" 10, which directs the flow of cooling medium in a certain predetermined direction in the cooling channel 5. Although FIG. 1 only shows one wing 10, it is obvious that a plurality of such can be arranged in different positions along the channel 5, for example in relatively wide parts of the channel 5, which otherwise would cause a fall of pressure in the cooling medium. FIG. 2 shows in more detail how such a flow directing element might be arranged in accordance with the invention.

FIG. 2 shows a cylinder block 1 which comprises five cylinders 2 and a cooling channel 5 which extends around the cylinders 2. A pipe 7 for supplying cooling medium is connected to the inlet 6 of the cooling channel 5. The cylinder block 1 also has a gasket 11 which is of a mainly conventional kind. The gasket 11 is preferably made of sheet metal and/or a plastic material and comprises apertures 12, the positions and dimensions of which correspond to the positions and dimensions of the cylinders 2. A (not shown) cylinder head will then be mounted on top of the gasket 11. According to the invention, there is further a supporting element 13 in the shape of a sheet of metal or plastic, which supports a plurality of flow directing elements 14 of the same kind as the wing 10 which was shown in FIG. 1. The supporting element 13 has essentially the same outer dimensions as the gasket 11 and comprises cut-out parts 15 which correspond to the positions of the cylinders 2.

The flow directing elements 14 protrude in a mainly perpendicular direction from the lower side of the supporting element 13, and are preferably shaped as thin wings which are mainly elongated. It should be noted that the flow directing elements 14 can also protrude into said (not shown) channels in the cylinder head. The wings 14 are dimensioned so that they protrude downwards a certain distance into the channel 5 at predetermined positions where the cooling medium needs to be directed or redirected. Seen in a cross-section, the wings 14 are somewhat curve-shaped, which effects an optimal control of the cooling medium which passes by.

The gasket 11 and the supporting element 13 are equipped with apertures 8 which permit the passage of cooling medium from the channel 5 to the other parts of the engine (preferably to the cylinder head), as has been described above in connection with FIG. 1.

When manufacturing the cylinder block 1, the supporting element 13 can easily be arranged on top of the cylinder block 1 so that the wings 14 protrude a distance downwards into the channel 5. Subsequently, the gasket 12 can be arranged on top of the supporting element 13, on top of which the cylinder head and the remaining components can be mounted.

According to an alternative embodiment of the invention, the gasket 11 and the supporting element 13 have been joined together in one single integrated unit. This can be done by, for example, gluing, welding, or the like. If the gasket 11 and the supporting element 13 constitute a "pre-assembled" unit, this can easily and simply be mounted on the cylinder block 1 when manufacturing the engine. In this way, the gasket 11 can also serve as a supporting element for the wings 14.

Figure 3:
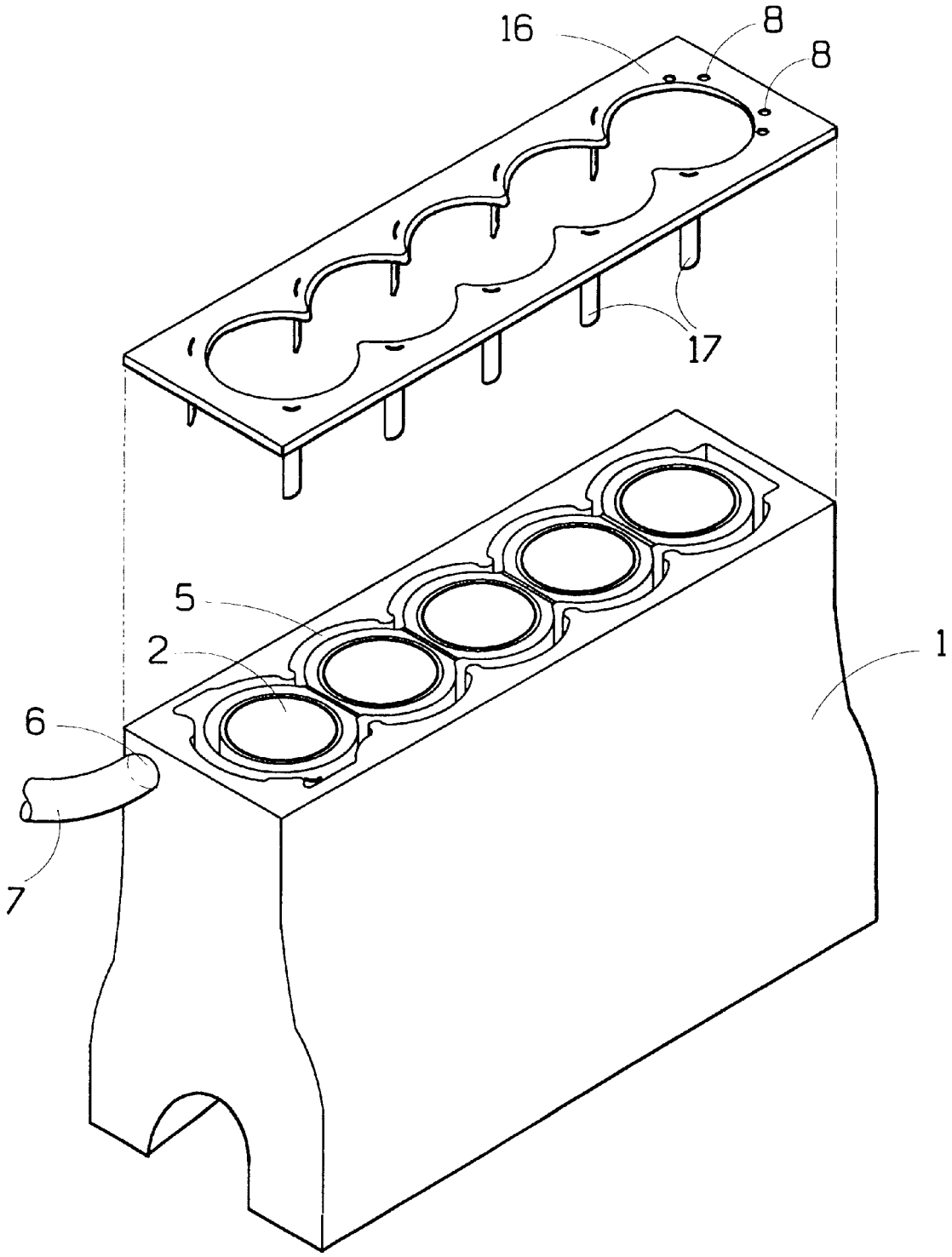
FIG. 3 is a perspective view of a further embodiment of the present invention.
Figure 4A:
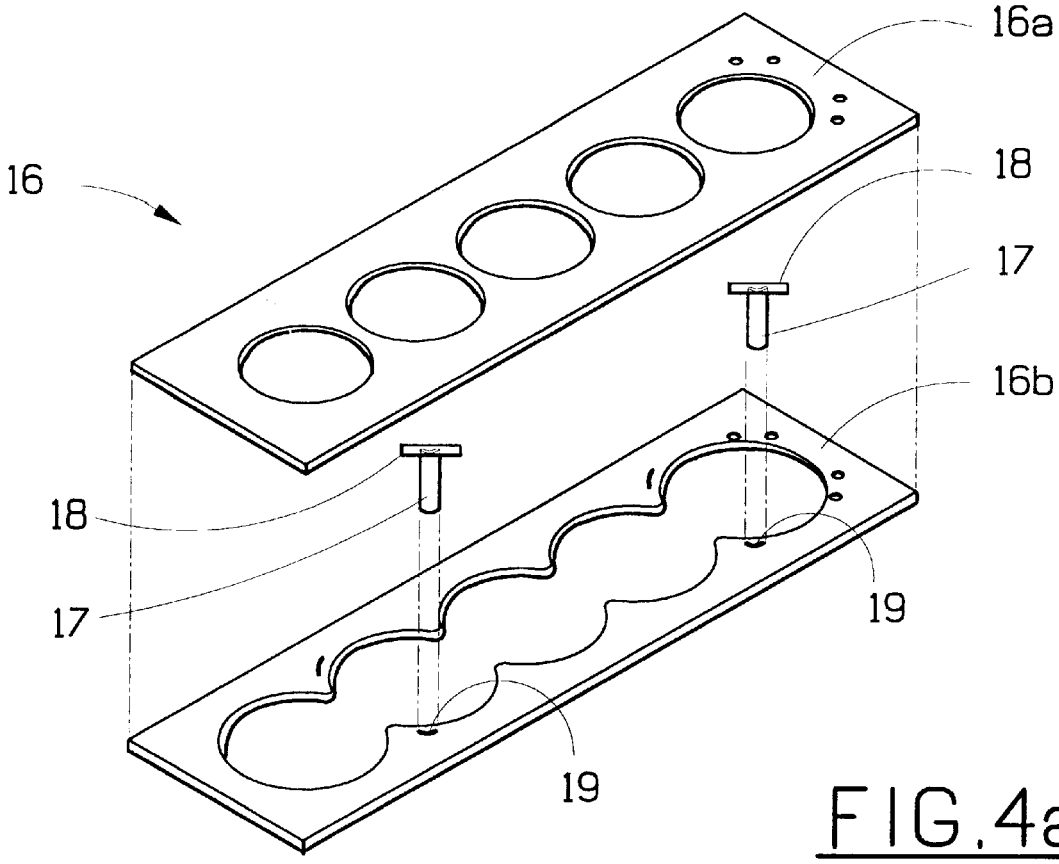
FIGS. 4*a* and 4*b* show the construction of the invention in the embodiment shown in FIG. 3.
Figure 4B:
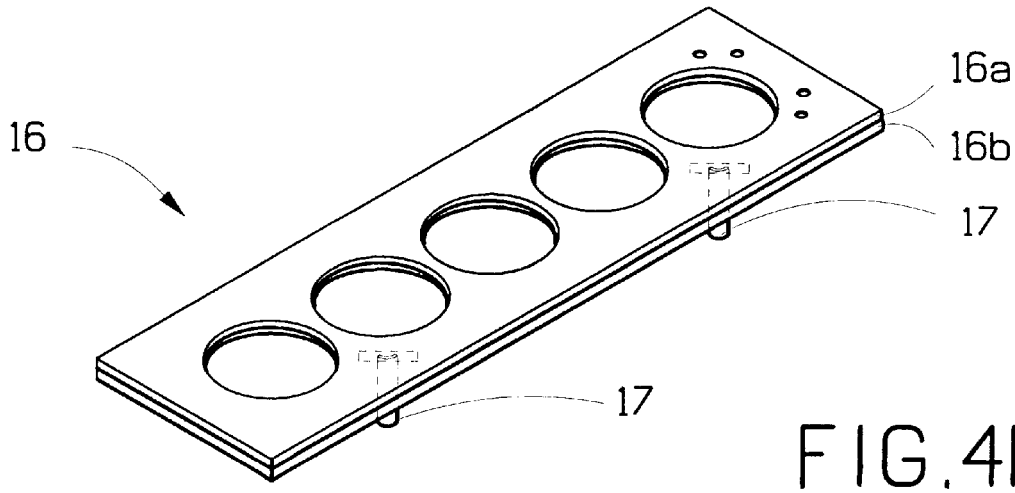

In FIGS. 3, 4*a* and 4*b*, a further embodiment of the invention is shown. In this embodiment, the gasket 16 consists of at least two layers 16*a*, 16*b*, which together form a laminated gasket. This embodiment also comprises flow directing elements 17, with the same function as has been described above. FIG. 4*a* shows the construction of the gasket 16. According to the embodiment, the gasket 16 consists of two separate gasket layers 16*a*, 16*b*, between which there is fixed at least one flow directing element 17 in the shape of a wing or the like. If a plurality of wings 17 is used, these can be connected by means of a sheet or the like, which can have essentially the same dimensions as the layers 16*a*, 16*b* of the gasket. They can also, as shown in FIG. 4*a*, consist of a plurality of separate elements 17, which are equipped with substantially sheet-shaped tabs 18, which can be fixed between the gasket layers 16*a*, 16*b*. The flow directing elements 17 are intended to protrude downwards through apertures 19 which have been made in the lower layer 16*b* of the gasket 16.

When assembling the gasket 16, the different layers 16*a*, 16*b* will be joined together, whereby the flaps 18 of the wings 17 are locked in a fixed position between the layers 16*a*, 16*b*. If necessary, the flaps 18 can also be attached to, for example, the lower layer 16*b* by gluing or welding. The finished gasket 16, shown in FIG. 4*b*, thus constitutes an integrated gasket and flow director, which serves as a supporting element for the flow directing elements 17 which, when mounted on the cylinder block 1, protrude downwards into the cooling channel in pre-arranged positions, as has been described earlier.

The flaps 18 can also consist of larger sheet-shaped elements which support more than one flow directing element.

Figure 5:
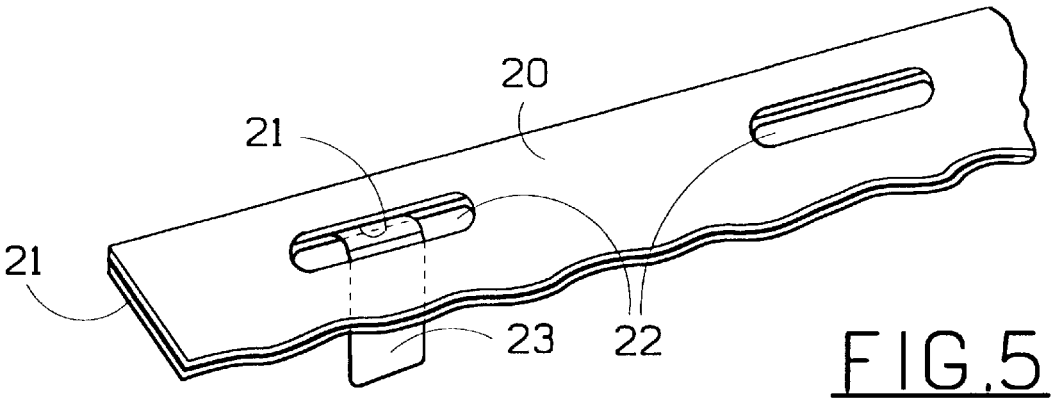
FIG. 5 is a perspective view of a part of a washer, which shows the invention in another embodiment.

FIG. 5 shows a further embodiment of the invention. This embodiment uses a gasket 20 with an embedded layer 21, made of metal or the like, and which serves as a reinforcing laminate layer. The gasket 20 can further be equipped with a plurality of apertures 22. At the positions of these apertures 22, the metal layer 21 is shaped with protruding tongues or similar parts, which are bent in a mainly perpendicular direction relative to the plane of the gasket 20. In this way, tongues 23 which protrude downwards are formed, which serve as flow directing elements. The gasket 20, which thus also serves as a supporting element for the flow directing element 23, can be mounted on a cylinder block 1, in which case the flow directing elements 23 protrude downwards into the channel for the cooling medium, as described above.

Figure 6:
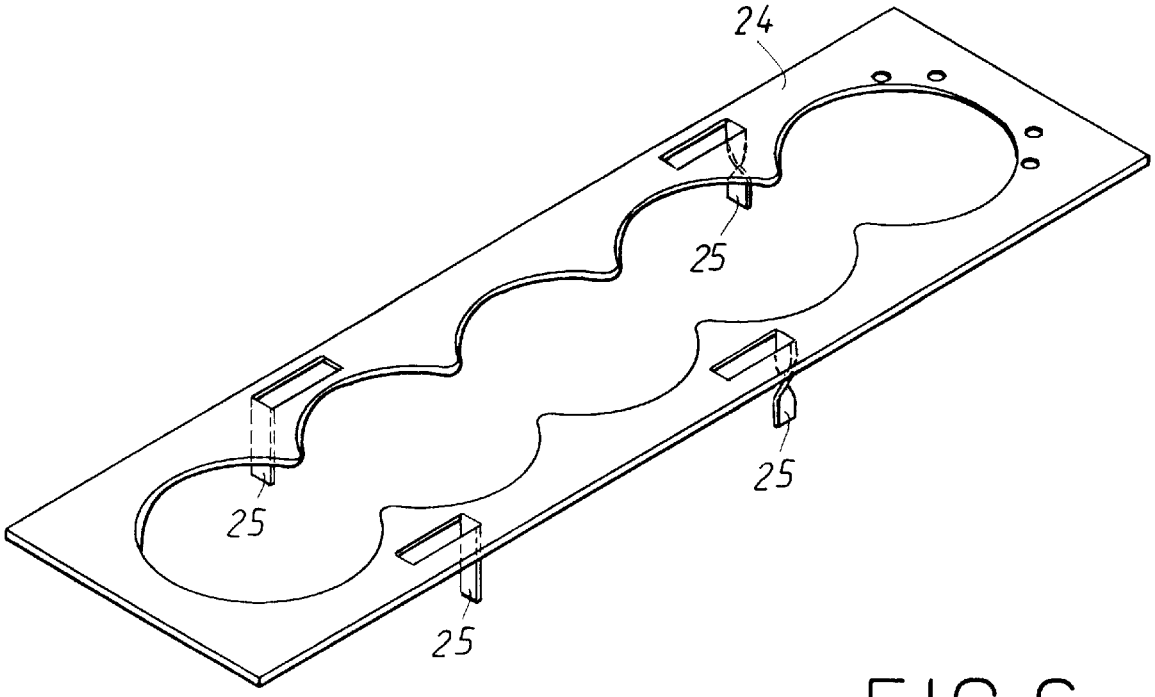
FIG. 6 shows the invention in another embodiment.

FIG. 6 shows a further embodiment of the invention, which uses a gasket 24, preferably made of sheet metal. In the gasket 24, details in the shape of flaps or wings are cut out, which are then bent so that they are arranged in a mainly perpendicular direction to the plane of the gasket 24. This imparts on the wings 25 the function of flow directing elements which protrude into a channel for a cooling medium, as has been described above. The positions where the wings 25 are cut out can be chosen so that there is no connection with a cylinder head. In this way, unintentional connection with the cylinder head is avoided. As can be seen in FIG. 6, the wings 25 can be given a somewhat screw-shaped form.

The invention is not limited to the described embodiments, but can be varied within the scope of the appended claims. For example, the flow directing elements can be placed in a plurality of various positions in the channel 5 in order to direct the flow of cooling medium as desired. The flow directing elements can be so placed that they entirely block a certain part of the channel, whereby the cooling medium is led along an alternative path past the cylinders. The latter alternative might be desirable if, for example, it is desired to direct the cooling medium through one or more of the apertures 4 (see FIG. 1).

The flow directing elements can further be shaped in many various ways, for example in the shape of wings, tongues or flaps. They can be given a curve-shaped cross-section in order to resemble the wing of an aeroplane. They can also protrude from their supporting element 13, 11, 16 or 20 at a straight angle or obliquely. The flow directing elements can be straight, or can be twisted along a screw line (see FIG. 6). The flow directing elements can further, in order to achieve a better attachment to the channels 5, be arranged so that they are in contact with the bottom or the walls of the cylinder block.

Finally, the invention can be used in cooling channels which are arranged in different parts of an internal combustion engine, for example in the cylinder block and the cylinder head.

I claim:

1. A device for control of the flow of a cooling medium through a channel in an internal combustion engine including a cylinder block and a cylinder head, said device comprising at least one flow directing element arranged in said channel for directing said cooling medium in a predetermined direction, and a supporting element supporting said at least one flow directing element said supporting element intended to be mounted on said internal combustion engine, and arranged between said cylinder block and said cylinder head, with said at least one flow directing element arranged so that it protrudes from said supporting element and into said channel.

2. A device for control of flow according to claim 1, wherein said the supporting element comprises an integrated part of a gasket arranged to be mounted on said internal combustion engine.

3. A device for control of flow according to claim 2, wherein said gasket comprises a plurality of layers, said at least one flow directing element fixedly arranged between two of said plurality of layers.

4. A device for control of flow according to claim 3, wherein said the flow directing element comprises a sheet-shaped element which is fixedly arranged between two of said plurality of layers.

5. A device for control of flow according to claim 2, wherein said gasket comprises at least one aperture and a laminate sheet embedded in said gasket and protruding through said aperture, wherein said protruding part of said laminate sheet serves as said at least one flow directing element.

6. A device for control of flow according to claim 1 wherein said flow directing element has an essentially wing-shaped cross-section.

* * * * *